US009951761B2

(12) United States Patent
Lucas et al.

(10) Patent No.: US 9,951,761 B2
(45) **Date of Patent: *Apr. 24, 2018**

(54) AERODYNAMIC PRESSURE PULSATION DAMPENER

(71) Applicant: Ingersoll-Rand Company, Davidson, NC (US)

(72) Inventors: Michael John Lucas, Mooresville, NC (US); Larry Rodney Stutts; James Richard Lindsey, Denver, NC (US)

(73) Assignee: Ingersoll-Rand Company, Davidson, NC (US)

( * ) Notice: Subject to any disclaimer, the term of this patent is extended or adjusted under 35 U.S.C. 154(b) by 522 days.

This patent is subject to a terminal disclaimer.

(21) Appl. No.: 14/597,859

(22) Filed: Jan. 15, 2015

(65) Prior Publication Data

US 2015/0198149 A1 Jul. 16, 2015

Related U.S. Application Data

(60) Provisional application No. 61/928,145, filed on Jan. 16, 2014.

(51) Int. Cl.
*F04B 39/00* (2006.01)
*F04B 11/00* (2006.01)
(Continued)

(52) U.S. Cl.
CPC ..... *F04B 39/0055* (2013.01); *F04B 11/0091* (2013.01); *F04B 39/0027* (2013.01);
(Continued)

(58) Field of Classification Search
CPC ..... F04B 39/0055; F04B 39/0027; F04B 39/066; F04B 39/123; F04B 39/16;
(Continued)

(56) References Cited

U.S. PATENT DOCUMENTS 2,943,641 A 7/1960 Arnold
3,134,394 A 5/1964 Ohta
(Continued)

FOREIGN PATENT DOCUMENTS

CN 101137840 A 3/2008
CN 101983288 A 3/2011
(Continued)

OTHER PUBLICATIONS

International Search Report, PCT/US2015/011702, Ingersoll-Rand Company, dated Jan. 14, 2016, 3 pages.
(Continued)

*Primary Examiner* — Devon Kramer
*Assistant Examiner* — Christopher Brunjes
(74) *Attorney, Agent, or Firm* — Taft Stettinius & Hollister

(57) ABSTRACT

A pressure pulse dampener for a compressor system is disclosed herein. The pulse dampener includes a housing having inlet passageway and an outlet passageway. A radially expanding annular passageway is formed downstream of the fluid inlet. A toroidal passageway is formed downstream of the annular passageway, the toroidal passageway being configured to direct fluid in a generally circumferential path around the central body. A connecting passageway is formed through the central body to provide fluid communication between the toroidal passageway and the fluid outlet.

22 Claims, 8 Drawing Sheets

(51) Int. Cl.
*F04C 29/06* (2006.01)
*F04C 15/00* (2006.01)
*F04D 29/66* (2006.01)

(52) U.S. Cl.
CPC ..... *F04C 15/0049* (2013.01); *F04C 29/06* (2013.01); *F04D 29/663* (2013.01)

(58) Field of Classification Search
CPC ..... F04B 11/0091; F04B 11/0008; F04B 43/026; F04B 49/06; F04B 2205/05; F04B 53/001; F04B 53/004; F04B 41/02; F04D 29/668; F16K 15/06; Y10T 137/7933; Y10T 137/7932; Y10T 137/7929; Y10T 137/7922; F04C 15/0049; F04C 29/0035; F04C 29/06; F04C 29/061; F04C 29/066; F04C 29/068
USPC ..... 417/312; 181/403; 138/42, 44
See application file for complete search history.

(56) References Cited

U.S. PATENT DOCUMENTS

| | | | | |
|---|---|---|---|---|
| 3,150,689 | A | 9/1964 | Lieberman | |
| 3,374,858 | A | 3/1968 | Richards | |
| 3,616,627 | A | 11/1971 | Everett et al. | |
| 3,635,309 | A | 1/1972 | Nemcansky et al. | |
| 4,076,468 | A | 2/1978 | Persson et al. | |
| 4,298,088 | A | 11/1981 | Keller | |
| 4,299,253 | A | 11/1981 | Burton | |
| 4,394,113 | A | 7/1983 | Bammert | |
| 4,478,054 | A | 10/1984 | Shaw et al. | |
| 4,758,136 | A | 7/1988 | Pamlin et al. | |
| 4,846,228 | A | 7/1989 | Blanscet | |
| 4,911,196 | A | 3/1990 | Kemp | |
| 5,037,282 | A | 8/1991 | Englund | |
| 5,046,480 | A * | 9/1991 | Harris | F04D 17/165 126/247 |
| 5,938,411 | A | 8/1999 | Seo | |
| 6,132,191 | A | 10/2000 | Hugenroth et al. | |
| 6,220,034 | B1 * | 4/2001 | Mowill | F02C 9/50 60/737 |
| 6,422,844 | B2 | 7/2002 | Hioki et al. | |
| 6,698,446 | B2 | 3/2004 | Cornwell | |
| 7,568,898 | B2 | 8/2009 | Shoulders | |
| 7,690,901 | B2 | 4/2010 | Achtelik et al. | |
| 8,136,547 | B2 | 3/2012 | Francini et al. | |
| 8,381,764 | B2 | 2/2013 | Matsubara et al. | |
| 2003/0155027 | A1 | 8/2003 | Michlin et al. | |
| 2006/0237081 | A1 | 10/2006 | Lucas et al. | |
| 2007/0215215 | A1 | 9/2007 | Arentsen et al. | |
| 2008/0256951 | A1 | 10/2008 | Delavan | |
| 2009/0218164 | A1 | 9/2009 | Lucas et al. | |
| 2010/0024891 | A1 | 2/2010 | Francini | |
| 2011/0135528 | A1 | 6/2011 | Amano | |
| 2012/0148435 | A1 | 6/2012 | Takaki | |
| 2015/0198179 | A1 * | 7/2015 | Lucas | F04D 29/668 137/14 |

FOREIGN PATENT DOCUMENTS

| | | | | |
|---|---|---|---|---|
| DE | 4118949 A1 | 12/1992 | | |
| DE | 29922878 | 6/2001 | | |
| GB | 2088947 A * | 6/1982 | | F01N 1/06 |
| WO | 2007128309 | 11/2007 | | |

OTHER PUBLICATIONS

Written Opinion, PCT/US2015/011702, Ingersoll-Rand Company, dated Jan. 14, 2016, 13 pages.
"Pulsation Damper Bladderless No Moving Parts Drawing Menu", internet product advertisement, as early as Oct. 2, 2014, 2 pages, PulseGuard, internet; http://www.pulsation-dampners.com/Bladderless-No-Moving_Parts_Drawings_Menue.html.
State Intellectual Property Office of People's Republic China Search Report for counterpart CN Application No. 201510043163.2 dated Dec. 8, 2017 (2 pages).
State Intellectual Property Office of People's Republic China English Translation of Search Report for counterpart CN Application No. 201510043163.2 dated Dec. 8, 2017 (2 pages).
State Intellectual Property Office of People's Republic China First Office Action for counterpart CN Application No. 201510043163.2 dated Dec. 18, 2017 (6 pages).
State Intellectual Property Office of People's Republic China English Translation of First Office Action for counterpart CN Application No. 201510043163.2 dated Dec. 18, 2017 (8 pages).

* cited by examiner

AERODYNAMIC PRESSURE PULSATION DAMPENER

CROSS REFERENCE TO RELATED APPLICATIONS

The present application claims the benefit of U.S. Provisional Patent Application 61/928,145 filed Jan. 16, 2014, the contents of which are incorporated herein by reference in their entirety.

BACKGROUND

The present disclosure generally relates to a pressure pulsation dampener and a compressor system including a pressure pulsation dampener. Pressure pulsations that may occur in a working fluid exiting a compressor, for example, may have a relatively large amplitude and may cause damage to downstream piping components and may cause relatively extreme noise levels. For instance, a typical oil-free compressor rated for 105 psi gage will have a dynamic pressure at the discharge of the compressor from 90 psig to 120 psig at a frequency related to the port passing frequency. The port passing frequency represents the number of times the compressor discharge port is opened to allow compressed air to exit the compressor. These pulsations begin at the discharge of the compressor and migrate downstream through the entire piping system.

Compressor machinery manufacturers may design pulsation suppression devices using traditional muffler style designs. Some pressure pulsation dampener designs may contain components traditionally found in mufflers and exhaust systems. Some dampener designs may include components such as choke tubes, orifice plates, branch tubes and Helmholtz resonators, absorptive linings, and/or perforated tubes. Muffler systems may be designed by acousticians using acoustic principles founded on solutions to the wave equation. In many muffler designs, it is assumed that the pressure pulsations propagate as an acoustic wave that travels at the speed of sound. The propagation of an acoustic wave is defined as the transport of energy through the compression and expansion of the molecules in the media in which the acoustic wave propagates. An acoustic wave propagates at the speed of sound and for air at room temperature the speed is around 341 msec.

Some existing systems have various shortcomings, drawbacks, and disadvantages relative to certain applications. Accordingly, there remains a need for further contributions in this area of technology.

SUMMARY

One embodiment of the present invention is a unique pressure pulsation dampener. Other embodiments include apparatuses, systems, devices, hardware, methods, and combinations for a pressure pulsation dampener. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
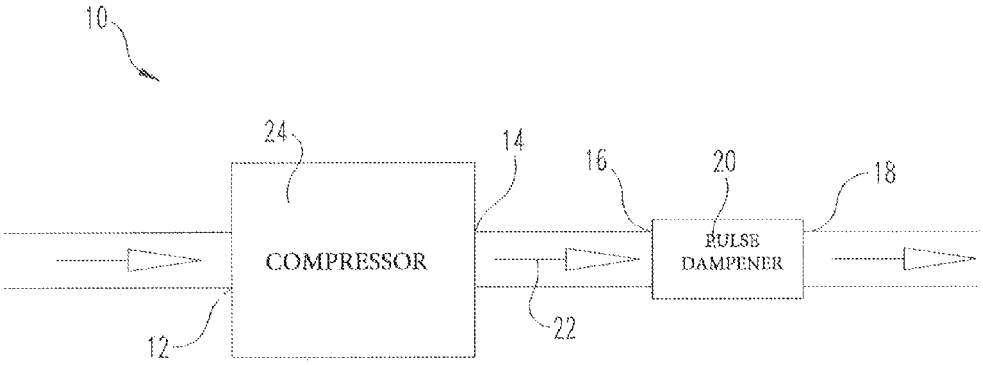
FIG. 1 is a schematic block diagram of an exemplary compressor system.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

The present specification is generally directed to suppressing, reducing, and/or dampening pressure pulsations in a working fluid near the source of the pulsations, or in the near-field. The pressure pulsation dampening device described herein may also be used to suppress pulsations in other fluid flows, and at the output of any device, such as a compressor or blower, as would be understood by one of ordinary skill in the art.

Passive noise and fluid dynamic control share similar physical principals. The wave speed of an acoustic field is the speed of sound while the wave speed of a fluid dynamic eddy (vortex) field is the convective speed of the gas. The wavelength for a gas dynamic flow is the length between two eddies. From acoustic study we know that $C=\lambda*f$, where C is the speed of sound, $\lambda$ is the acoustic wavelength, and f is the frequency. From Fluid Dynamics we know that $U=L*F$, where U is the convective speed of the gas L is the eddy distance of separation, and f is the frequency of the gas unsteady dynamic. In compressors C is typically much greater than U, i.e. the Mach number defined as $m=u/c$ is less than 0.2 in most compressor applications. Given the above relationships, a passive control device for gas dynamics will require smaller geometric length (λ is much greater than L) scales to successfully cancel an oscillation. The present disclosure teaches a gas dynamic passive cancellation device. The length scales for this device are chosen based on a gas velocity of U. Acoustic fields may persist from a compressor despite the presence of this device, but the apparatus and methods disclosed herein will attenuate any further generation of an acoustic field by canceling the eddies. As will be explained in further detail below, an annular entrance with one defined exit on the side of the pulse dampener will cause the flow streamlines and associated eddies to travel different lengths therethrough as each path length is different depending on the flow azimuth entrance angle.

Near the discharge of a compressor, in the near-field, there are pressure pulsations in the fluid at the compressor outlet that are generated by unsteady gas dynamic flows. The gas dynamic becomes the origin for pressure pulsations that propagates as an aerodynamic wave that travels at the convective speed of the gas. Generally, the main source of noise in the near-field is due to gas dynamic disturbances originating from the opening and closing of the discharge port at the outlet of the compressor. The generation of pressure pulsations near the discharge of the compressor may be described as an aerodynamic phenomenon. Downstream from the compressor discharge port, the aerodynamic instabilities become smaller while the pressure pulsation disturbances evolve into an acoustic field. The acoustic field propagates at the speed of sound and it is the acoustic field that is the source of noise we hear from the compressor.

The working fluid exiting a compressor may be described as slugs of fluid that are discharged each time the rotors open and close. The gas flow is primarily influenced by its aerodynamic properties in the near-field; the pressure pulsations travel at the convective speed of the slugs of air and their speed is dictated by the mass flow through the compressor and the cross-sectional area of the piping. Further downstream, in the far-field, the slugs of fluid break down into smaller eddy structures. The aerodynamic component of the pressure pulsations still exists in the far-field, but its strength in amplitude has generally diminished. The acoustic component of the pressure pulsation, which has been present all along, now becomes the dominant pressure term.

The present disclosure describes an aerodynamic device that needs no moving parts to dampen the pressure pulsations in a working fluid. The pulsation dampener creates a specially designed flow path for the working fluid in the near-field, which plays a central role in attenuating the pressure pulsations of a compressor or blower. As another effect of dampening the pressure pulsations in the near-field of the working fluid flow based on aerodynamic principles, the acoustic vibrations in the far field of the working fluid flow may also be diminished. The term aerodynamics, as used herein, includes fluid dynamics and/or gas dynamics, depending on the working fluid being used in the particular pressure pulsation dampener.

Referring to the drawings, and in particular FIG. 1, aspects of a non-limiting example of a compressor system 10 are depicted in accordance with an embodiment of the present specification. Compressor system 10 may include a compressor or blower 24 having an inlet 12 and an outlet 14 at the discharge side. A working fluid 22 travels into the compressor via the inlet 12 and exits the compressor via the outlet 14. Compressor outlet 14 is in flow communication with the inlet 16 of the pressure pulsation dampener 20, directly or indirectly.

In one form, compressor 24 is a screw compressor. In a particular form, compressor 24 is an oil-free screw compressor. In other embodiments, compressor 24 may be a piston compressor, a lobed compressor, or any positive displacement compressor. In still other embodiments, compressor 24 may be a centrifugal compressor, a vane compressor, a blower, a fan, or a fluid pump. Compressor 24 is configured to discharge a pressurized working fluid 22 via the compressor outlet 14 and on to a desired location. Compressor 24 may also be any apparatus that is capable of expelling a working fluid that contains pressure pulsations in need of damping, as would be understood by one of ordinary skill in the art.

In one embodiment, compressor 24 pressurizes a working fluid 22, such as air, and discharges the pressurized fluid at the outlet 14 for use by the downstream components. The pressurized working fluid 22 may travel directly or indirectly to the inlet 16 of a pressure pulsation dampener 20. The working fluid 22 then exits the pressure pulsation dampener 20 at its outlet 18 with smaller amplitude of pressure pulsations than were present in the fluid 22 upon entering at the inlet 16.

Figure 2:
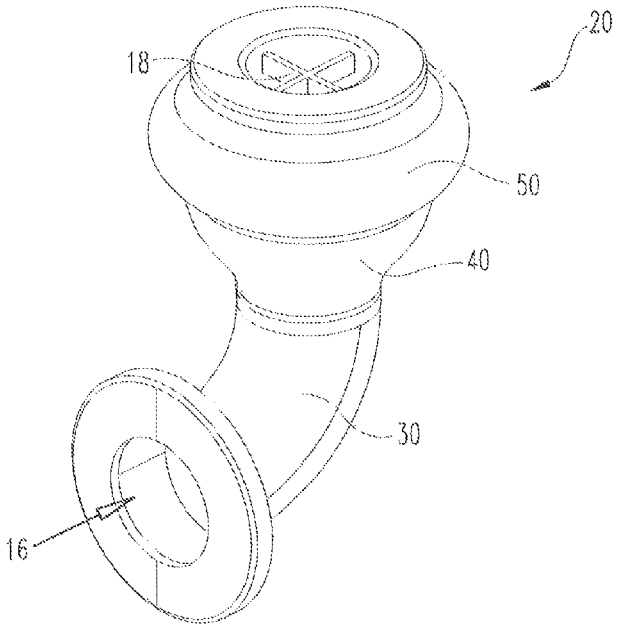
FIG. 2 is a side view of an exemplary pressure pulsation dampener.

Referring to FIG. 2, a non-limiting example of a pressure pulsation dampener 20 is depicted in accordance with an embodiment of the present disclosure. In one embodiment, pressure pulsation dampener 20 may be cast as one part out of ductile iron or any other suitable material.

Figure 3:
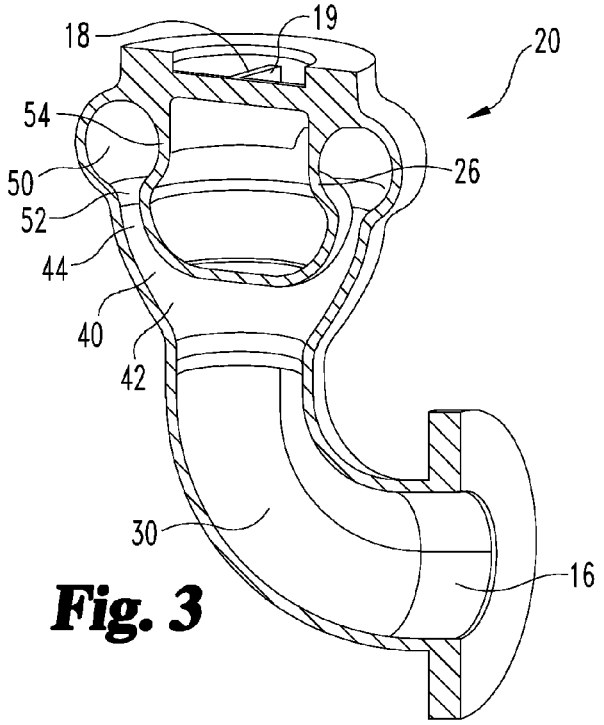
FIG. 3 is a cross sectional illustration of a side view of an exemplary pressure pulsation dampener.

As shown in FIG. 3, in one embodiment, a working fluid 22 such as air enters the chamber 30 from the inlet 16, then is directed into an annular section 40. The annular section 40 may be an annulus that expands radially in the axial direction of flow. For example, the annular section 40 may have a higher rate of radial expansion at the inlet of the annular section 40 than at the outlet, resulting in an annular section 40 in the general shape of a bell. The pressure pulsation dampener 20 is shaped to then guide the fluid flow into a ring chamber 50, where the flow of the fluid is transverse to the annular section 40. The ring chamber 50 may have a toroidal shape as shown in FIG. 3, but other shapes are contemplated.

The pressure pulsation dampener 20 is shaped to allow the fluid flowing in annular section 40 to enter toroidal chamber 50 at any point around the circumference of toroidal chamber 50. The working fluid 22 then exits from one single port of the toroidal chamber 50. In one embodiment, the working fluid 22 exits from one exit opening 26 located on the inner circumference 54 of the toroidal chamber 50. In another embodiment, the working fluid 22 exits from one exit opening located on the outer circumference of the toroidal chamber 50. In other embodiments, the working fluid 22 may exit at other locations of the toroidal chamber 50 and/or through other types of outlets. The distance the air travels inside the toroidal chamber 50 depends on the compass direction the air follows before entering the chamber 50.

For example, the working fluid 22 will travel further when the working fluid 22 enters the toroidal chamber 50 one hundred eighty degrees from the exit opening 26 of the toroidal chamber 50 and the working fluid 22 is flowing in the direction of the exit opening than if it enters the chamber one degree from the exit opening 26 and it is traveling in a direction toward the opening 26. When the vortex structures in the working fluid 22 rejoin at the exit opening 26 of the toroidal chamber 50, the sum is averaged together. The phase differences resulting from the combined differences in the length of travel for the different flow paths yield a net flow that cancels the large eddy structures, thereby reducing the pressure pulsations caused by eddy structures or vortices in the air flow.

The pressure pulsation dampener 20 is designed to dampen the aerodynamic component of the pressure pulsation in the near-field of the working fluid 22 flowing out of a compressor 24, for example. Reduction in acoustic wave occurrences in the far-field may result from effective dampening in the near-field.

FIG. 3 also shows that the shape of the dampener 20 in the annular section 40 may expand radially in the axial direction of the fluid flow path, with a larger maximum annular radius for the flow area at the outlet 44 of the annular section 40 than at the inlet 42 of the annular section. In one particular embodiment, the maximum annular radius expands more rapidly at the inlet 42 of the annular flow path than at the outlet 44 of the annular flow path, giving the dampener 20 a bell shape in the annular flow section 40.

The working fluid 22 exiting the outlet 44 of the annular section 40 is then directed to enter the toroidal chamber 50. It is contemplated that the working fluid 22 may enter at any point around the circumference of the toroidal chamber 50. In the embodiment shown in FIG. 3, the working fluid 22 from the annular section 40 may enter at the bottom of the toroidal chamber 50 and the annular flow-toroidal flow junction 52 may consist of an unobstructed annulus. The annular flow-toroidal flow junction 52 may be partially obstructed in other embodiments with ports and/or vanes, for example, as would be understood by one of ordinary skill in the art. Guide vanes and/or ports (not shown) may also be employed at various other points inside the body of the pressure pulsation dampener 20 without departing from the object of the present specification. The working fluid 22 then travels within the toroidal chamber 50 in a direction generally transverse to the annular flow path 40 until it reaches the exit opening 26 of the toroidal chamber. The working fluid 22 within toroidal chamber 50 may travel in a clockwise or in a counterclockwise direction, depending on the compass direction the air follows before entering toroidal chamber 50. In one embodiment, the exit opening 26 of the toroidal chamber 50 is located on the inner circumference of the toroidal chamber 50.

Figure 4:
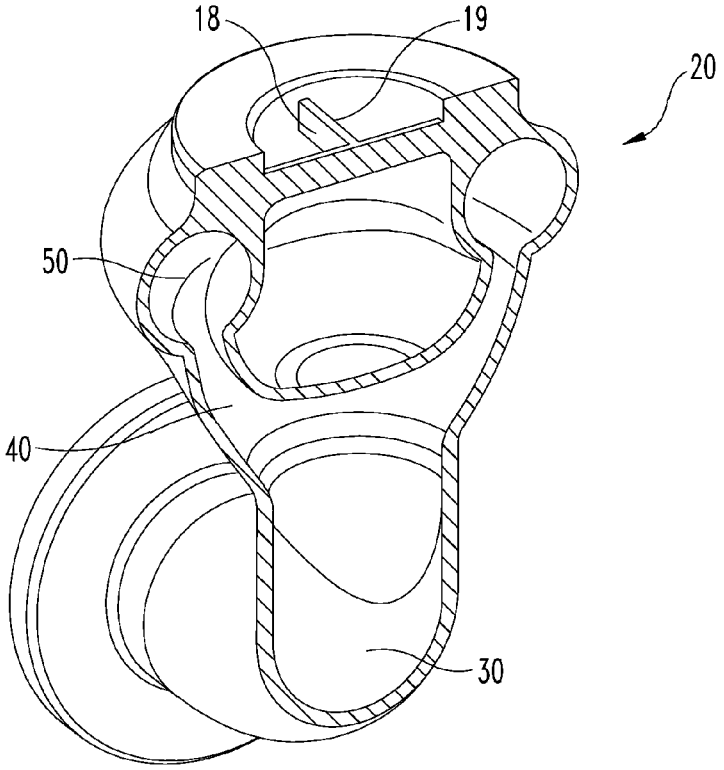
FIG. 4 is a cross sectional illustration of an elevated side view of an exemplary pressure pulsation dampener.

FIG. 4 shows a cross sectional illustration of an elevated side view of an embodiment of a pressure pulsation dampener 20. Once the working fluid 22 exits the toroidal chamber 50 at exit opening 26 (see FIG. 6), the pressure pulsation dampener 20 directs the working fluid 22 to the outlet 18. In one embodiment, the working fluid flow exiting the outlet 18 of the pressure pulsation dampener 20 is transverse to the flow path within the toroidal chamber 50. In some embodiments one or guide vanes 19 may be employed to direct a portion of the fluid flow in a desired direction. In one form the guide vanes may be positioned within the outlet flowpath 18.

Figure 5:
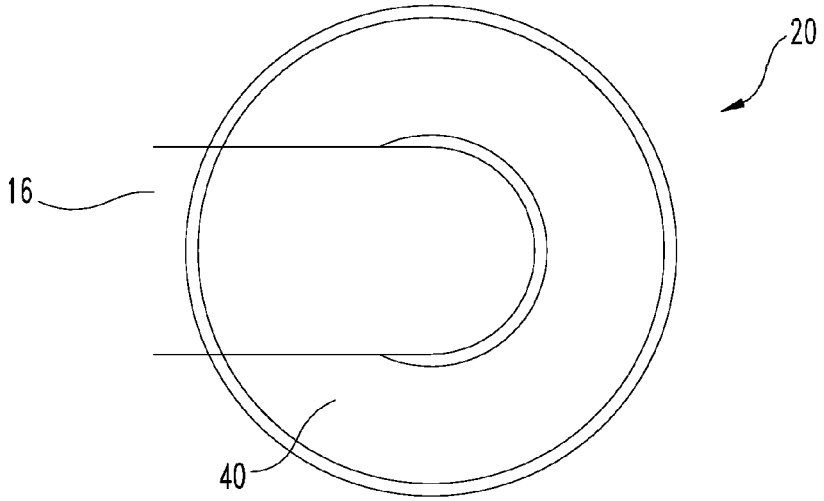
FIG. 5 is a bottom view of an exemplary pressure pulsation dampener.

FIG. 5 is a bottom view of an embodiment of the exemplary pressure pulsation dampener 20. The working fluid 22 enters the pressure pulsation dampener 20 at the inlet 16 at a direction transverse to the annular section 40 of the pressure pulsation dampener 20. In other embodiments, the working fluid 22 may enter the pressure pulsation dampener 20 from other directions.

Figure 6:
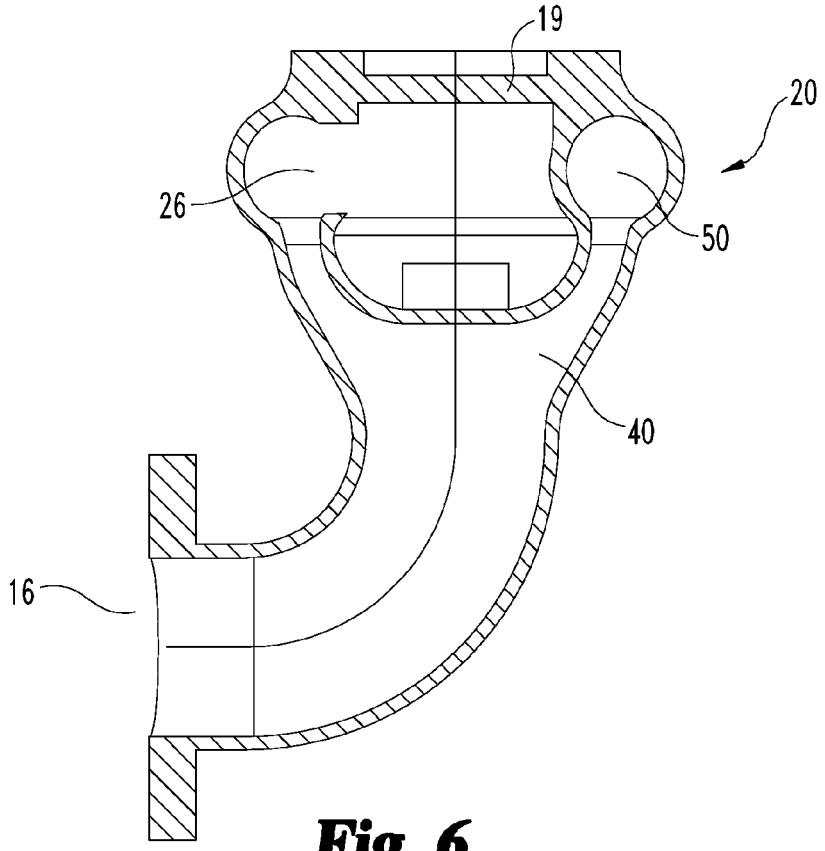
FIG. 6 is a cross sectional illustration of a side view of an exemplary pressure pulsation dampener.

FIG. 6 is a cross sectional illustration of a side view of the exemplary pressure pulsation dampener 20. The inlet 16 of the pressure pulsation dampener 20, the annular section 40, and the toroidal chamber 50 are shown. The exit opening 26 of the toroidal chamber 50, which in some embodiments is located on the inner circumference of the toroidal chamber 50, is also shown.

Figure 7:
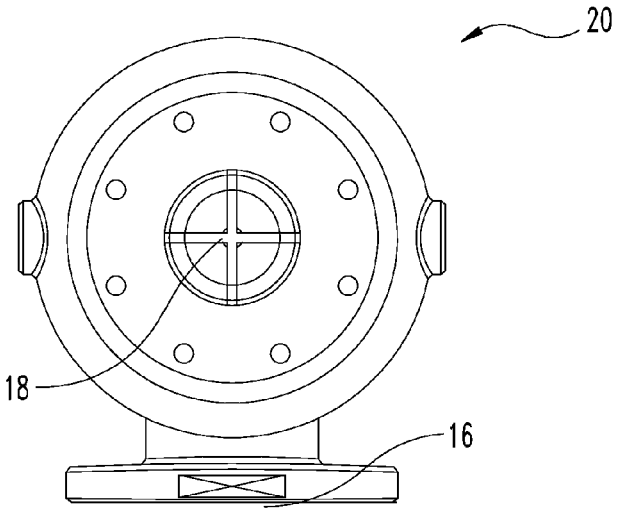
FIG. 7 is a top view of an exemplary pressure pulsation dampener.

FIG. 7 is a top view of an embodiment of the exemplary pressure pulsation dampener 20. In one embodiment, the pressure pulsation dampener 20 inlet 16 is shown, configured to allow a working fluid 22 to enter the pressure pulsation dampener 20 from a direction transverse to the direction the working fluid exits the dampener 20. Other embodiments may allow the working fluid 22 to enter and exit in a different manner. The dampener outlet 18 is also shown, allowing the working fluid 22 to exit the pressure pulsation dampener 20 from the top of the dampener 20.

Figure 8:
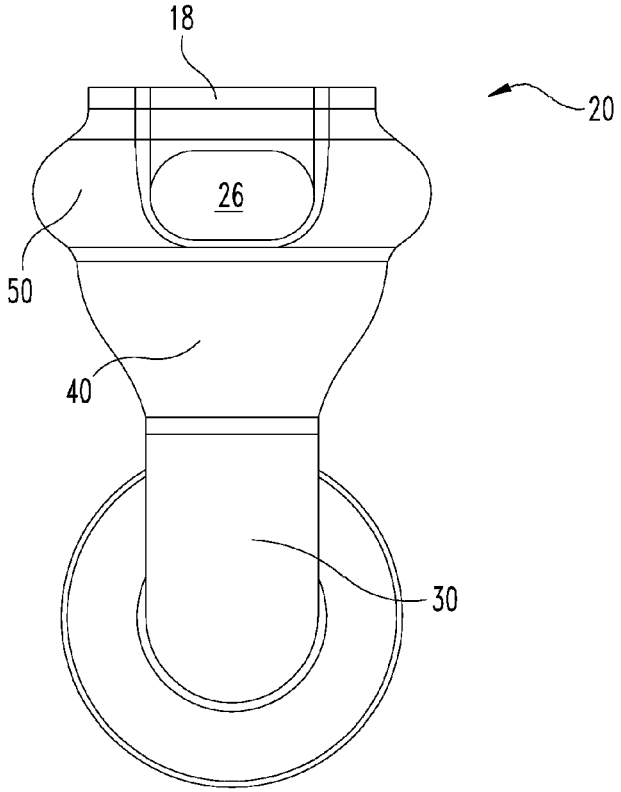
FIG. 8 is a front view of an exemplary pressure pulsation dampener with a portion of the top section of the dampener shown in cross section.

FIG. 8 is a front view of the pressure pulsation dampener 20 with a portion of the toroidal chamber 50 of the pressure pulsation dampener 20 shown cut-away. In one embodiment, the pressure pulsation dampener 20 includes the chamber 30 to receive the working fluid 22 that initially enters the pressure pulsation dampener 20 at inlet 16. The chamber 30 is structured to direct the working fluid 22 into annular section 40. The working fluid 22 is then directed into the toroidal chamber 50 and then through the port 29 toward the dampener exit 18.

Figure 9:
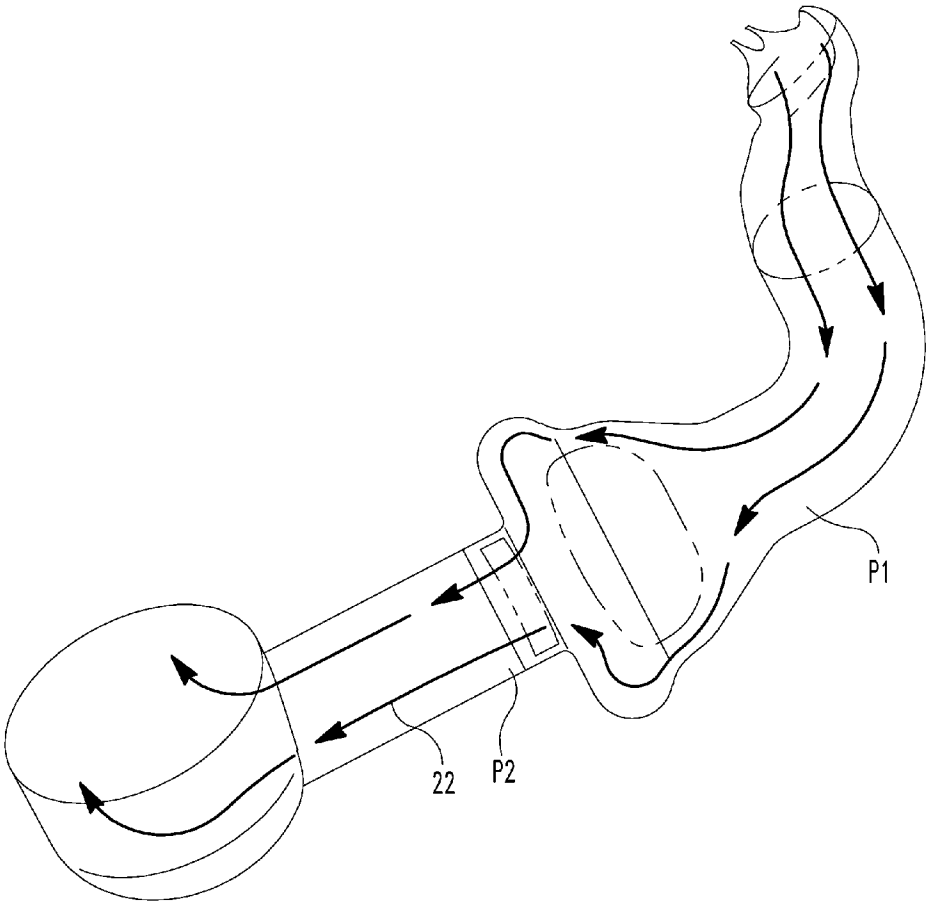
FIG. 9 is an exemplary illustration of working fluid streamlines showing fluid pressure as the fluid travels through an exemplary pressure pulsation dampener.

FIG. 9 is an illustration of working fluid streamlines as the fluid travels through an embodiment of the pressure pulsation dampener 20. The working fluid 22 that enters the pressure pulsation dampener 20 is modeled such that the working fluid flow accurately simulates the time dependent discharge conditions at the exit 14 of a compressor 24, for example, CFD modeling has shown that pressure gradients P1 in the fluid traveling into the annular section 40 of the pressure pulsation dampener 20 is generally higher than the pressure gradients P2 of the fluid exiting the pressure pulsation dampener 20.

Figure 10:
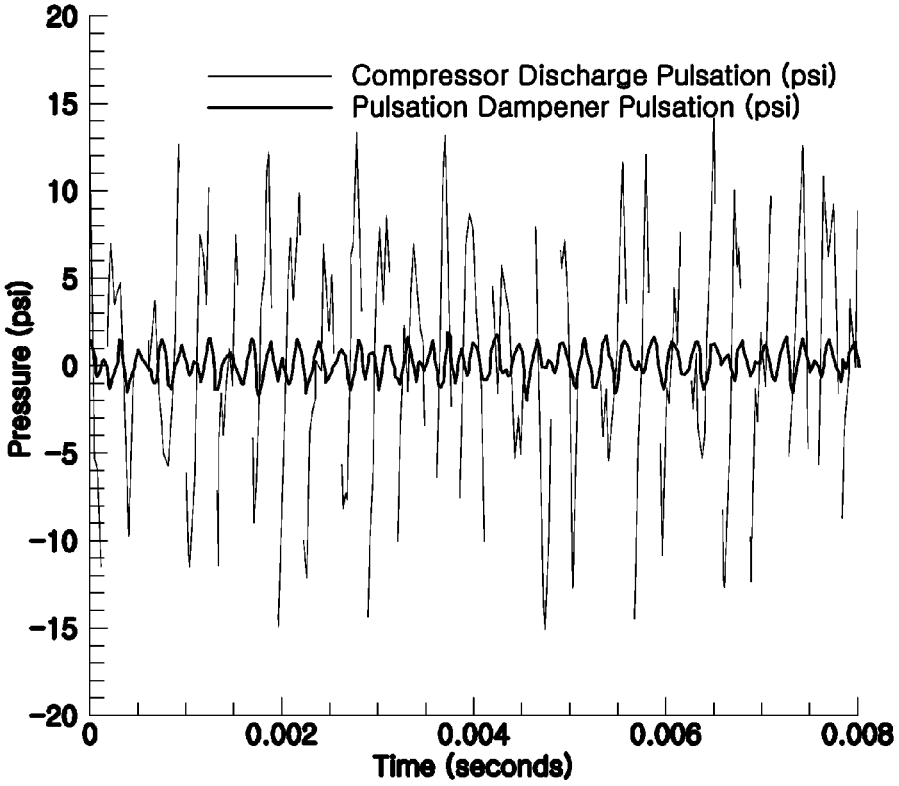
FIG. 10 is an exemplary graph of the pressure pulsations measured at the compressor discharge and at the pulsation dampener outlet as a function of time.

FIG. 10 is an exemplary prophetic graph of the pressure pulsations measured at the compressor discharge outlet 14 and at the pulsation dampener outlet 18 as a function of time. The measurements show that the pressure pulsation dampener 20 reduces the peak-to-peak amplitude of the pulsations in the working fluid 22 as compared to pressure pulsations in the working fluid 22 upon discharge from a compressor 24.

Figure 11:
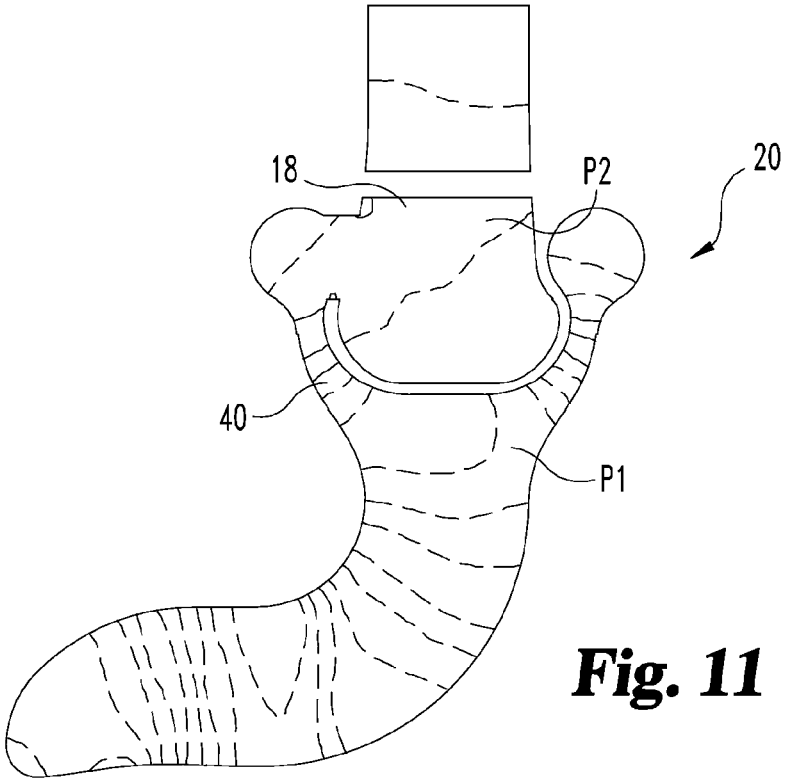
FIG. 11 is an exemplary illustration of the pressure in the working fluid streamlines showing fluid pressure as the fluid travels through an exemplary pressure pulsation dampener.

FIG. 11 is a diagram showing a side view of an embodiment of the pressure pulsation dampener 20 with lines indicating each change in pressure. The pressure gradient is steeper in fluid moving through the annular section 40 labeled as P1 than that of the fluid exiting the pressure pulsation dampener 20 labeled as P2.

Figure 12:
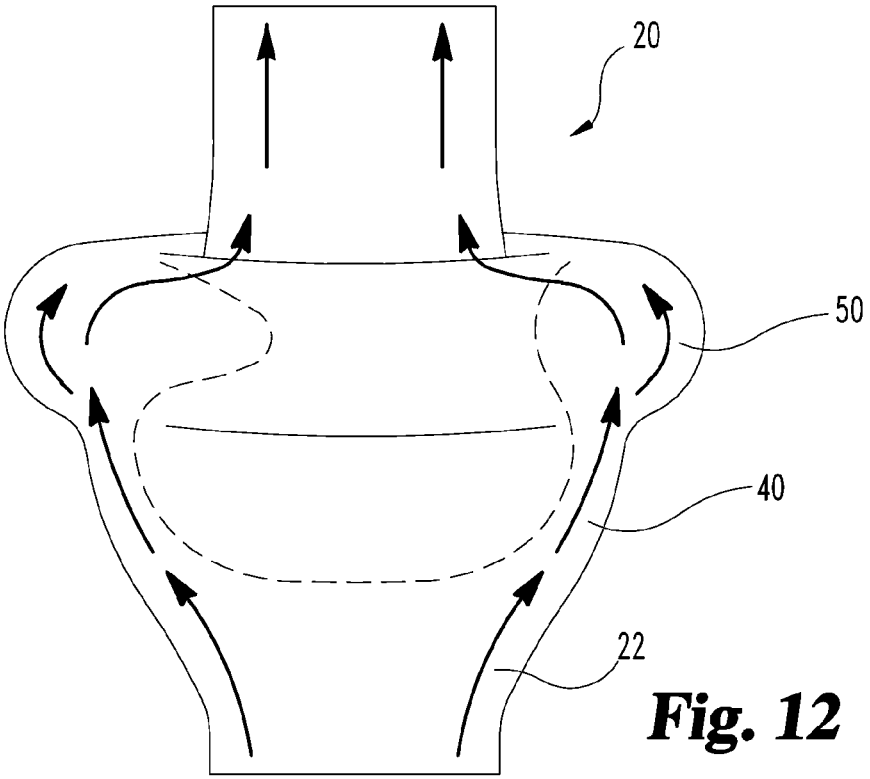
FIG. 12 is an exemplary illustration of streamlines showing working fluid flow through an exemplary pressure pulsation dampener.

FIG. 12 is a side view of an embodiment of the pressure pulsation dampener 20 showing streamlines to represent the flow path that working fluid 22 may take through the pressure pulsation dampener. As the working fluid 22 travels from annular section 40 into the toroidal chamber 50, there may be some separated, turbulent, or recirculating flow, as shown by the streamlines and as would be understood by one of ordinary skill in the art.

Figure 13:
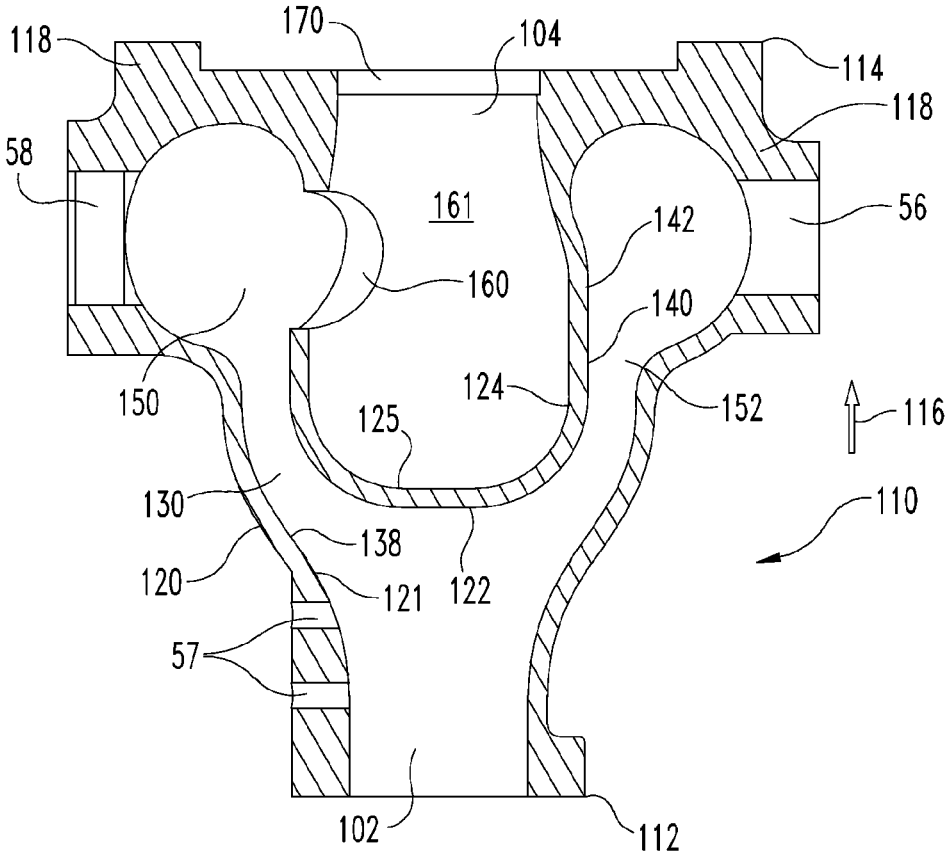
FIG. 13 is a cross-sectional side view of an exemplary pressure pulsation dampener.

Referring to FIG. 13 the operation of the pressure pulse dampener system can be readily ascertained. A source of unsteady fluid flow, such as that generated by a fluid compressor is delivered to an inlet passageway 102 of a pressure pulse dampener 110. The pulse dampener 110 extends between first and second ends 112, 114. The fluid generally flows into the inlet 102 and out of the outlet 104 in an axial direction represented by arrow 116, however it should be understood that variable flow patterns other than those described herein are contemplated as one skilled in art would understand. The pulse dampener 110 includes a housing 118 with an outer wall 120 that generally defines a radially outer flowpath boundary 121 along a length thereof. A central body 122 (also described as an inner body or center body) is positioned within the housing 118 radially inward of the outer wall 120. While terms such as central or center may be used to describe the central body 122 or other components in the system, it should be understood that those terms do not require the central body or any similarly described component to be positioned in a geometric center location of the housing 118 and may indeed be located at any desired location within the housing.

The central body 122 includes perimeter wall 124 that defines a shape of the central body 122. In one form the central body 122 can be substantially hollow and in other forms the central body can be partially hollow. A central passageway or annular flowpath 130 is formed between the outer wall 120 and the perimeter wall 124 of the central body 122. In one form the central passageway 130 is substantially bell shaped, in other forms the shape can vary as the flowpath 130 generally moves radially outward along the axial flowpath direction defined by arrow 116. The perimeter wall 124 is not limited to one configuration or shape and can be defined by any one of a plurality of shapes. In one form a forward end 125 may include linear portions as illustrated, but may also include accurate portions in alternate embodiments.

The radially outer flowpath boundary 121 of the central passageway 130 can be defined by an inner surface 138 of the outer wall 120. A radially inner flowpath boundary 140 of the central passageway 130 can be defined by an outer surface 142 of the perimeter wall 124 of the central body 122. In one form a cross-sectional area of the inlet 102 can be substantially equivalent to a cross-sectional flow area of the central passageway 130 to minimize pressure losses due to expansion and contraction along the flowpath. Furthermore the cross-sectional flow area can remain substantially constant along a flow direction of the central passageway 130.

A ring or toroidal chamber 150 can be positioned downstream of the central passageway 130. The toroidal chamber 150 forms a circumferential passageway about the central body 122 and can have cross-sectional shape desired including circular, ovalized, or combinations of linear and arcuate segments, such that pressure pulsation are dampened and overall pressure loss is minimized. A 360 degree transition channel 152 is positioned between the central passageway 130 and the toroidal chamber 150 and functions as a flow outlet of the central passageway 130 and a flow inlet to the toroidal chamber 150. The toroidal chamber 150 generally directs the fluid flow into a circumferential flow pattern from a generally axial and radially outward direction defined by the central passageway 130. A toroidal outlet port 160 is formed in the perimeter wall 124 of the central body 122. The outlet port 160 can be of any shape and size as desired, however in one form shown in the exemplary embodiment the shape can be ovalized and the flow area is substantially equivalent to the flow area of the transition channel 152. Individual flow streamlines will flow about the circumferential toroidal chamber 150 in either a clockwise or counter clockwise direction dictated by fluid dynamic forces such as velocity, direction, angular momentum and position of entry into the chamber 150 relative the location of the outlet port 160. As each streamline takes a different path to the outlet port, the unsteady portion of the flow caused by eddy or vorticity flow will be at least partially reduced or cancelled out which in turn causes a reduction of a portion of the pressure pulsing in the fluid flow. After the fluid exits the toroidal chamber 150 through the outlet port 160, the fluid is directed radially inward into the hollow portion 161 of the central body 122 and out of the pulse dampener 110 through the outlet flowpath 104. In some embodiments, an outlet guide vane 170 can be positioned in one or more of the flow paths of the pulse dampener 110 to promote a desired flow velocity.

In one aspect the present disclosure includes a system comprising: a compressor operable for compressing a fluid; a pulse dampener in fluid communication with compressed fluid downstream of the compressor, the pulse dampener having a housing having first and second ends including: an outer circumferential wall having an inner surface defining an outer radial flowpath wall; an inlet passageway defined by the outer circumferential wall; a central body having an open cavity positioned downstream of the inlet passageway; a central passageway formed about the central body being defined by a perimeter wall of the central body and the outer circumferential wall positioned radially outward from the perimeter wall; a toroidal passageway formed around the central body downstream of the central passageway; an inlet aperture formed through the perimeter wall to provide fluid communication between the toroidal passageway and the open cavity within the central body; and an outlet passageway formed downstream of the open cavity of the central body.

In refining aspects the present disclosure further includes an outlet guide vane poisoned within the outlet passageway; wherein the inlet passageway includes a curved portion; wherein compressed fluid from the compressor includes unsteady flow caused by vortices and pressure wave pulsations and wherein the pulsation damper is operable to reduce the unsteady flow; wherein the inlet passageway, central passageway and outlet passageway of the pulse dampener include a substantially equivalent cross-sectional flow area along the direction of fluid flow; wherein a cross-sectional area of the toroidal passageway is at least partially circular; wherein a cross-sectional area of the toroidal passageway is at least partially non-circular; wherein the perimeter wall of the central body defines an inner boundary of a substantially bell shaped central passageway; wherein the perimeter wall of the central body includes a flattened portion at a forward end thereof; and wherein the central passageway projects radially outward at a decreasing rate along the passageway from an entry location to an exit location.

Another aspect of the present disclosure includes a pressure pulse dampener comprising: a housing having first and second ends, wherein the first end defines an fluid inlet passageway and the second end defines a fluid outlet passageway, the inlet passageway and the outlet passageway configured to direct fluid at least partially in an axial direction; a radially expanding annular passageway formed downstream of the fluid inlet; a toroidal passageway formed downstream of the annular passageway, the toroidal passageway configured to direct fluid in a generally circumferential path around an axis defined by the axial direction; and a connecting passageway formed to provide fluid communication between the toroidal passageway and the fluid outlet.

In refining aspects the present disclosure includes a central body having an open cavity positioned downstream of the inlet passageway; a perimeter wall of the central body defining an inner boundary of the radially expanding annular passageway; and an outer wall of the housing positioned radially outward from the perimeter wall defining an outer boundary of the radially expanding annular passageway; wherein the annular passageway and the toroidal passageway have inlet flow areas extending 360 degrees around the central body; a port aperture formed in the perimeter wall of the central body to define a flow exit area of the toroidal passageway; wherein the port aperture is defined by an area that is less an area of the of a wall defining the toriodal passageway; wherein the port aperture is defined by an area that is approximately equal to an inlet flow area of the toriodal passageway; wherein the port aperture is defined by an ovalized shape; wherein the port aperture is defined by a non-ovalized shape; wherein the toriodal passageway is defined by a partial circular cross-sectional shape; an outlet guide vane positioned proximate the outlet passageway; wherein an annular radius of the annular passageway expands more rapidly at an inlet of the annular passageway than at an outlet of the annular passageway along a flow direction; wherein the housing is made from a single casting.

In another aspect of the present disclosure, a method is disclosed for reducing pressure pulsations in a working fluid comprising: receiving the working fluid at an inlet of a pressure pulsation dampener; directing the working fluid into an annular section that is in fluid communication with the inlet, wherein the annular section includes a portion that expands radially outward along a flowpath projected in an axial direction; transporting the working fluid into a 360 degree inlet of a ring chamber in downstream fluid communication with the annular section; flowing portions of the working fluid in clockwise and other portions in a counter-clockwise direction along a circumferential pathway of the ring chamber; directing the working fluid radially inward through a single exit port in a wall of the ring chamber; and discharging the working fluid to an outlet of the pressure pulsation dampener.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system comprising:

a compressor operable for compressing a fluid;

a pulse dampener in fluid communication with compressed fluid of the compressor, the pulse dampener having a housing including:

an outer circumferential wall having an inner surface defining an outer radial flowpath wall;

an inlet passageway defined by the outer circumferential wall;

a central body having an open cavity positioned downstream of the inlet passageway;

a central passageway formed about the central body being defined by a perimeter wall of the central body and the outer circumferential wall positioned radially outward from the perimeter wall;

a toroidal passageway formed around the central body downstream of the central passageway;

an inlet aperture formed through the perimeter wall to provide fluid communication between the toroidal passageway and the open cavity within the central body; and an outlet passageway formed downstream of the open cavity of the central body.

2. The system of claim 1, further comprising an outlet guide vane positioned within the outlet passageway.

3. The system of claim 1, wherein the inlet passageway includes a curved portion.

4. The system of claim 1, wherein compressed fluid from the compressor includes unsteady flow caused by vortices and pressure wave pulsations and wherein the pulsation damper is operable to reduce the unsteady flow.

5. The system of claim 1, wherein the inlet passageway, central passageway and outlet passageway of the pulse dampener include a substantially equivalent cross-sectional flow area along the direction of fluid flow.

6. The system of claim 1, wherein a cross-sectional area of the toroidal passageway is at least partially circular.

7. The system of claim 1, wherein a cross-sectional area of the toroidal passageway is at least partially non-circular.

8. The system of claim 1, wherein the perimeter wall of the central body defines an inner boundary of a substantially bell shaped central passageway.

9. The system of claim 1, wherein the perimeter wall of the central body includes a flattened portion at a forward end thereof.

10. The system of claim 1, wherein the central passageway projects radially outward at a decreasing rate along the passageway from an entry location to an exit location.

11. A pressure pulse dampener comprising:

a housing of the pressure pulse dampener having a first end defining, a fluid inlet passageway and a second end defining, a fluid outlet passageway, the fluid inlet passageway and the fluid outlet passageway configured to direct fluid at least partially in an axial direction;

a radially expanding annular passageway formed in the housing downstream of the fluid inlet passageway;

a central body having an open cavity positioned downstream of the inlet passageway;

a perimeter wall of the central body defining an inner boundary of the radially expanding annular passageway;

an outer wall of the housing positioned radially outward from the perimeter wall defining an outer boundary of the radially expanding annular passageway;

a toroidal passageway formed downstream of the annular passageway, the toroidal passageway configured to direct fluid in a generally circumferential path around an axis defined by the axial direction; and a connecting passageway formed to provide fluid communication between the toroidal passageway and the fluid outlet passageway.

12. The pressure pulse dampener of claim 11, wherein the annular passageway and the toroidal passageway have inlet flow areas extending 360 degrees around the central body.

13. The pressure pulse dampener of claim 11, further comprising:

a port aperture formed in the perimeter wall of the central body to define a flow exit area of the toroidal passageway.

14. The pressure pulse dampener of claim 13, wherein the port aperture is defined by an area that is less an area of the of a wall defining the toriodal passageway.

15. The pressure pulse dampener of claim 13, wherein the port aperture is defined by an area that is approximately equal to an inlet flow area of the toriodal passageway.

16. The pressure pulse dampener of claim 13, wherein the port aperture is defined by an ovalized shape.

17. The pressure pulse dampener of claim 13, wherein the port aperture is defined by a non-ovalized shape.

18. The pressure pulse dampener of claim 11, wherein the toriodal passageway is defined by a partial circular cross-sectional shape.

19. The pressure pulse dampener of claim 11, further comprising:

an outlet guide vane positioned proximate the outlet passageway.

20. The pressure pulse dampener of claim 11, wherein an annular radius of the annular passageway expands more rapidly at an inlet of the annular passageway than at an outlet of the annular passageway along a flow direction.

21. The pressure pulse dampener of claim 11, wherein the housing is made from a single casting.

22. A method for reducing pressure pulsations in a working fluid comprising:

receiving the working fluid at an inlet of a pressure pulsation dampener;

directing the working fluid into an annular section that is in fluid communication with the inlet, wherein the annular section includes a portion that expands radially outward along a flowpath projected in an axial direction;

transporting the working fluid into a 360 degree inlet of a ring chamber in downstream fluid communication with the annular section;

flowing portions of the working fluid in clockwise and other, portions in a counterclockwise direction along a circumferential pathway of the ring chamber;

directing the working fluid radially inward through a single exit port in a wall of the ring chamber; and discharging the working fluid to an outlet of the pressure pulsation dampener.

* * * * *